US006675590B2

(12) United States Patent
Aarestrup

(10) Patent No.: US 6,675,590 B2
(45) Date of Patent: Jan. 13, 2004

(54) COOLING DEVICE

(75) Inventor: Jan Caroe Aarestrup, Bjerringbro (DK)

(73) Assignee: Grunfos A/S, Bjerringbro (DK)

( * ) Notice: Subject to any disclaimer, the term of this patent is extended or adjusted under 35 U.S.C. 154(b) by 128 days.

(21) Appl. No.: 09/747,629

(22) Filed: Dec. 22, 2000

(65) Prior Publication Data

US 2001/0037655 A1 Nov. 8, 2001

(30) Foreign Application Priority Data

Dec. 23, 1999 (DE) ..... 199 62 728

(51) Int. Cl.[7] ..... F25B 49/02

(52) U.S. Cl. ..... 62/126; 62/228.4; 62/259.2; 62/513

(58) Field of Search ..... 62/125, 126, 127, 62/129, 130, 259.2, 228.4, 513; 236/51, DIG. 12, DIG. 19, 94

(56) References Cited

U.S. PATENT DOCUMENTS

| | | | | |
|---|---|---|---|---|
| 4,404,813 A | | 9/1983 | Paddock | 62/127 |
| 5,012,656 A | | 5/1991 | Tamura | 62/498 |
| 5,231,848 A | | 8/1993 | Farr | 62/229 |
| 5,629,574 A | | 5/1997 | Cognetti | 310/71 |
| 5,764,022 A | | 6/1998 | Kazama | 318/801 |
| 6,116,512 A | * | 9/2000 | Dushane et al. | 236/51 |

FOREIGN PATENT DOCUMENTS

| | | | | |
|---|---|---|---|---|
| DE | 1 109 191 | | 6/1961 | |
| DE | 38 74 925 | | 3/1988 | |
| DE | 197 47 256 | | 2/1999 | G05D/23/19 |
| EP | 0504567 | | 9/1992 | F25D/29/00 |
| EP | 827 855 | | 8/1997 | |
| EP | 0 859 208 | | 8/1998 | F25D/29/00 |
| JP | 2-157554 | * | 6/1990 | 62/259.2 |
| JP | 6-294577 | | 10/1994 | F25D/29/00 |
| JP | 8-219635 | | 8/1996 | F25D/29/00 |

* cited by examiner

*Primary Examiner*—Harry B. Tanner
(74) *Attorney, Agent, or Firm*—Cohen, Pontani, Lieberman & Pavane

(57) ABSTRACT

A refrigerator or freezer includes a compressor with an electrical drive motor. The drive motor is activated by a rotational speed controller. The compressor is connected to a cooling medium circuit which contains a condenser, an evaporator and an expansion means arranged therebetween. The cooling device comprises a cooling space closable with a door as well as a temperature control for the cooling space. The rotational speed controller and the temperature control are grouped together to a constructional unit.

19 Claims, 8 Drawing Sheets

COOLING DEVICE

BACKGROUND OF THE INVENTION

1. Field of the Invention

The present invention relates to a cooling device such as a refrigerator or freezer in the form of a cupboard or a chest with a cooling space surrounded by a wall and a door.

2. Description of the Related Art

Cooling devices may include, for example, refrigerators, freezers, refrigerator-freezer combinations, and deep freezes. These types of cooling devices are typically manufactured on a large scale. Since these devices are mass produced, even slight simplifications with the manufacture and assembly may lead to high savings in costs. Most cooling devices are thermostat-controlled in that they are switched on and off according to the temperature of the refrigeration space. However, some newer cooling device also include an electronic rotational speed controller for controlling the motor which drives the compressor. These types of controllers such as, for example, frequency converters may be miniaturized and manufactured at acceptable costs. A cooling device having such a controller is disclosed, for example, in PCT/DK96/00300. In the cooling device disclosed by this reference, the compressor is designed as an essentially closed pot and the frequency converter is seated within a box attached laterally to this pot.

The arrangement of the frequency converter in a box attached laterally to a pot of the compressor is not desirable for many reasons. Many individual components are required to be cabled to the refrigerator controller which is complicated and thus expensive and prone to breakdown. Furthermore, the compressor pot is subjected to severe mechanical oscillations which are caused by the rotation of the motor and the oscillation of the piston which forms a complex mechanical oscillation formation. This is why the compressor pot is usually suspended using a soft suspension such as rubber mounts. The oscillations exerted onto the sensitive frequency converter electronics may cause fractures of the circuitboard, contact weaknesses, or other disturbances created by mechanical oscillations. When a repair is required, both the compressor pot and the frequency converter are required to be exchanged since these are designed as a unit. Since these components make up a large part of the total price of the cooling device, it would be desirable to be able to exchange these components individually. Furthermore the arrangement of the frequency converter on the compressor pot may subject the frequency converter to thermal energy which is also undesireable.

SUMMARY OF THE INVENTION

It is an object of the present invention to provide a cooling device with a drive motor of a compressor activated by an electronic rotational speed controller which overcomes the problems of the prior art. The cooling device is inexpensive to manufacture, functions reliably and is repair-friendly.

The object is achieved by a cooling device having a cooling space wall and a door defining a cooling space, a compressor having an electrical drive motor, a rotational speed controller operatively connected for controlling the electrical drive motor, a cooling medium circuit having a condenser, an evaporator and an expansion means arranged between the condenser and the evaporator, a temperature control for controlling the temperature of cooling space temperature, and a constructional unit in which both the rotational speed controller and the temperature control are arranged. The constructional unit is arranged so that said constructional unit is spacially separated from the compressor.

The present invention groups the rotational speed controller together with the temperature control in one constructional unit to provide a unit which is exchangeable separately from the compressor. Furthermore, the constructional unit is designed to be exchanged quickly and simply during a repair. This constructional unit formed of at least the temperature control and rotational speed controller forms a central connection component of the cooling device. The main power supply for the cooling device is connected to this constructional unit. The output of the rotational speed controller is connected to the compressor via a connection cable. Further cable connections are made as required by the arrangement and scope of the constructional unit.

The constructional unit may be arranged on the compressor. In that case, the constructional unit may be attached on the compressor housing via an oscillation-damped connection. However, the constructional unit comprising the rotational speed controller and at least a temperature control is preferably arranged spacially separated from the compressor. Such an arrangement has the considerable advantage that the sensitive electronics of the constructional unit may be arranged where it is favorable with regard to the oscillation loading and heat removal. Furthermore, all of the electronics of the cooling device are grouped together in a constructional unit. Apart from the rotational speed controller and the temperature control, further electrical or electronic components may also be arranged in the constructional unit when appropriate. When the electronics are arranged so that they are spacially separated from the compressor or at least in an oscillation-insulated and/or thermally-insulated from the compressor, the long-term behavior improves which leads to an improved operational dependability of the whole cooling device. Furthermore, the compressor and electronics may be exchanged separately during repairs. The separate exchangeability of the compressor and electronics is important because exchanging the compressor requires that the coolant circuit be opened which entails complicated mechanical interventions in the system. In contrast, the exchange of the electronics requires only a release of a screw or snap connections and the electrical contacts. Accordingly, the removal to the electronics may be carried out by less qualified personnel, i.e., knowledge of the coolant circuit is not required. Finally, the constructional unit may be arranged with as many further components as possible so that the number of components to be assembled in the cooling device may be further reduced. The further components may, for example, include lighting, temperature display, operating condition display, temperature sensor. Where appropriate, these further components are integrated into the constructional unit.

The constructional unit may also include a sensor for acquiring a reference variable for the cooling space temperature control, specifically for the control. Such a sensor may in its simplest form be a temperature sensor. However, the temperature may also be acquired indirectly via dampness or other suitable sensors. If such a temperature sensor is provided in the constructional unit, the conducting path for the signal to the control electronics is short. The sensor according to the arrangement of the constructional unit may be arranged within the constructional unit so that the sensor projects through a recess in a wall of the cooling device into the space to be cooled while the remaining part of the constructional unit is arranged outside. However, the sensor may also be arranged on the outer side of the wall and connected to this in a heat-conducting manner, so that a penetration through of the cooling space wall may be spared. This in turn brings advantages with respect to the heat insulation of the cooling space as well as the demands on the seal of the constructional unit.

For the arrangement of the constructional unit within the cooling device, there are many possibilities from which to select depending on the constructional size of the refrigerator, on the waste heat to be removed in the power electronics, and on other demands on the design. The constructional unit may be seated within the cooling space or outside. If it is seated outside it may bear on the walling limiting the cooling space or may be arranged at a distance to this. The latter arrangement is favorable when the waste heat of the power electronics which are arranged within the constructional unit is to be dissipated away completely to the surrounding air and not indirectly or directly via the cooling medium. At the same time the constructional unit may be arranged in the air-side convection flow of the condenser. The constructional unit is preferably arranged below the condenser since the air is at its coldest. If a removal of the waste heat is to be provided via the cooling medium then it is useful to arrange the constructional unit either within the cooling space or directly bordering on the wall defining the cooling space or at least connected in a heat-conducting manner to the wall. In arrangements in which the operating parts are included as a part of the constructional unit, the constructional unit is to be arranged such that the operating parts are accessible to the user.

The rotational speed controller may include a frequency converter. However, the speed controller may also be formed as a phase control or even as a pulse cascade circuit. With the latter, the electronics include a switch and control which controls the switch.

If the constructional unit is arranged within the cooling space or directly bordering the door or lid, then the door or lid switch contact for the cooling space lighting may be integrated in the constructional unit and where appropriate also the lighting itself. Furthermore with an arrangement of the constructional unit within the cooling space it may be useful to co-integrate into the constructional unit a fan for circulating the air located in the cooling space. The air circulation improves the waste heat removal and also creates a largely uniform temperature distribution within the whole cooling space.

If a transmitting and/or receiver device for wireless data transmission of the device is to be provided, then this is usually integrated into the constructional unit. Accordingly, all the electronics of the cooling device are grouped together in the constructional unit which brings with it advantages with respect to manufacturing technology. The wireless data transmission function may, for example, allow the setting of the cooling space temperature from the outside or for incorporating the device into a computer-controlled system. The provision of a remote control may be used when the arrangement of the constructional unit is such that a direct access for setting purposes is not possible or is difficult.

When the cooling device comprises a freezing apparatus in which the cooling space temperature is designed to be significantly below 0° C., a defrosting at least of the evaporator is required at periodic intervals. The defrosting may be effected largely or completely automatically by way of a suitable defrosting control. The defrosting control may be integrated in the constructional unit. It may be useful to integrate the constructional unit into the door or flap of the cooling device since then it is easily accessible and there may also be co-integrated further switches and displays.

The cooling of the power electronics by the cooling medium itself or via the air located in the cooling space, although being effective and permitting a high degree of miniaturization of the power electronics, worsens the total efficiency of the device. Thus alternatively to this, the constructional unit may be arranged near or on the outer side of the device so that the waste heat of the power electronics is removed via the surrounding air. According to the spacial conditions it may also be useful to provide a convection cooling to the outside as well as also a cooling via the cooling medium or the cooling space.

High quality refrigerator-freezer combinations are usually provided with two compressors. These devices also include two electronic rotational speed controllers and temperature controls. These rotational speed controllers and temperature controls may be unified in a common constructional unit.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1A:
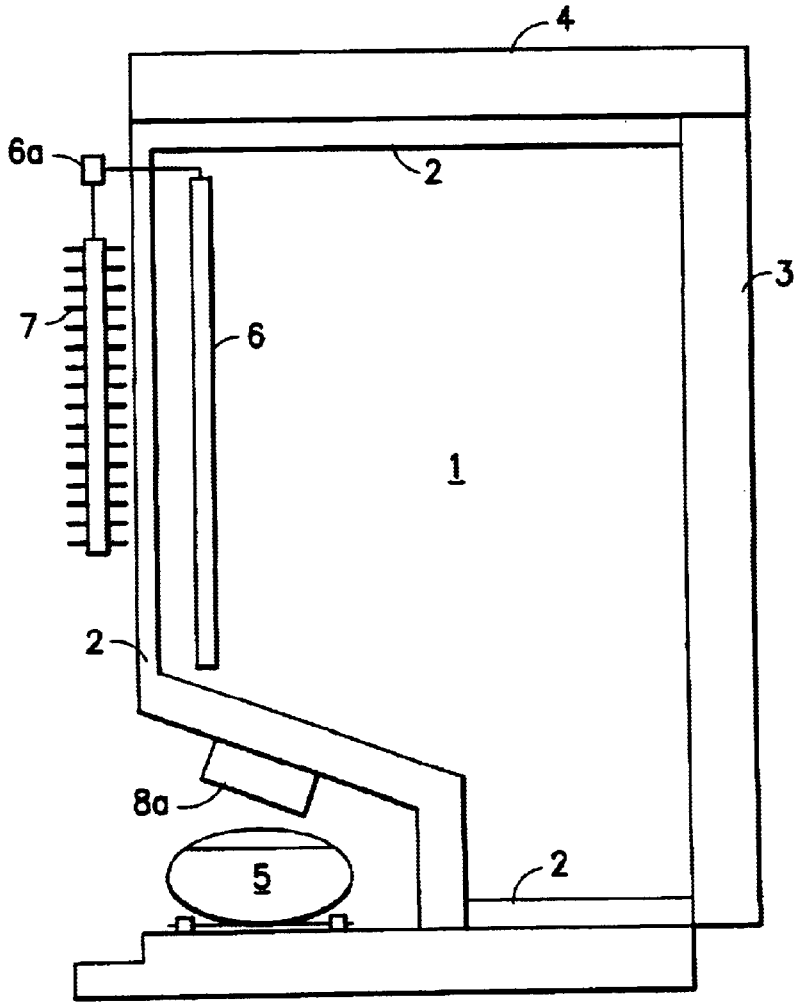
FIG. 1*a* is a schematic sectional view of a cooling device with a constructional unit according to an embodiment of the present invention.

The cooling device shown in FIG. 1*a* is a refrigerator with a wall 2 enclosing a cooling space 1. The front side of the cooling space 1 is closed by a door 3. An insulation 4 is arranged on the outer side of the wall 2 as is usual with such cooling devices. In the interests of brevity and clarity, the insulation 4 in FIG. 1 is only shown on the upper side of the wall 2. However, the insulation 4 is actually present along the entire outer side of the wall 2 and the door 3. The lower rear-side region of the wall 2 projects forward in a step-like manner to create a free space for a compressor 5 which is usually arranged there. The compressor 5 may be designed as either a closed compressor pot or as an open system. The compressor is connected via a lead (not shown) to an evaporator 6 which is provided on the rear side within the cooling space 1. The evaporator 6 is in connection with an expansion device 6*a* which is in connection with a condenser 7 arranged on the rear side at a distance from the outer side of the wall 2 and whose entry again is connected to the compressor exit.

The compressor 5 is not described in detail here and comprises an electric motor which is activated by an electronic rotational speed controller in the form of a frequency converter. The frequency converter in turn is controlled by a temperature control which monitors the cooling temperature. The electronics of the frequency converter and the control electronics are grouped together in a constructional unit 8*a* and together with the remaining electronics of the apparatus are arranged in a common housing.

FIGS. 1*a*–1*i* show nine arrangements of constructional units 8*a* to 8*i* on the cooling device. It is to be understood that the constructional units 8*a* to 8*i* shown in FIGS. 1*a*–1*i* vary in detail according to whether for example they comprise the temperature sensor, the fan, the lamp, the switch, a display or further components. However, each of the constructional units 8*a*–8*i* includes the frequency converter and the control electronics. Further electronics such as, for example, for controlling the expansion device 6*a* which is usually provided on the compressor side, may also be co-integrated into these constructional units 8*a*–8*i*.

Figure 1C:
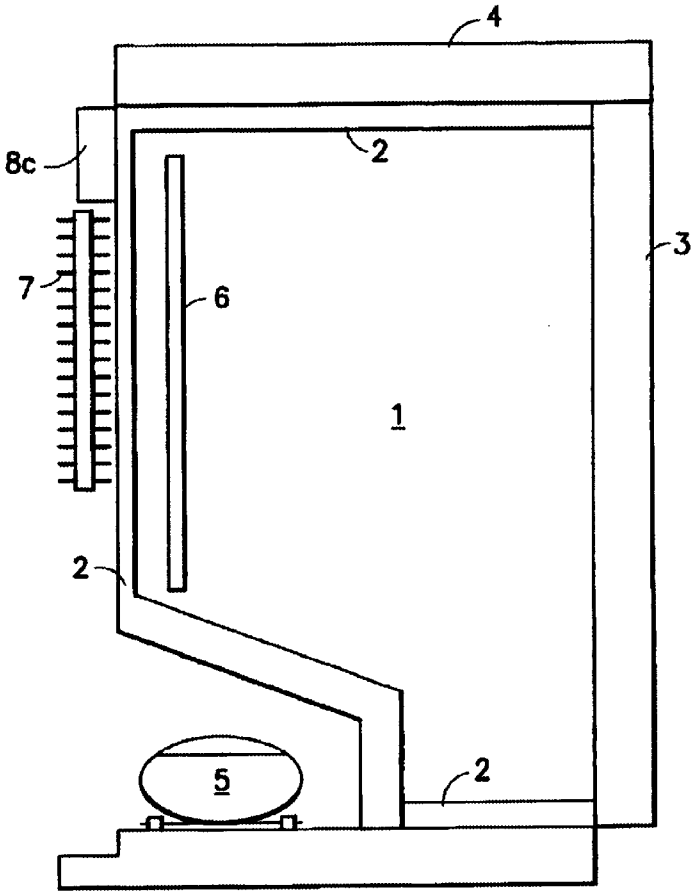
FIGS. 1*b–i* are schematic sectional views of cooling devices similar to FIG. 1*a* showing embodiments having different arrangements of the constructional unit.
Figure 1B:
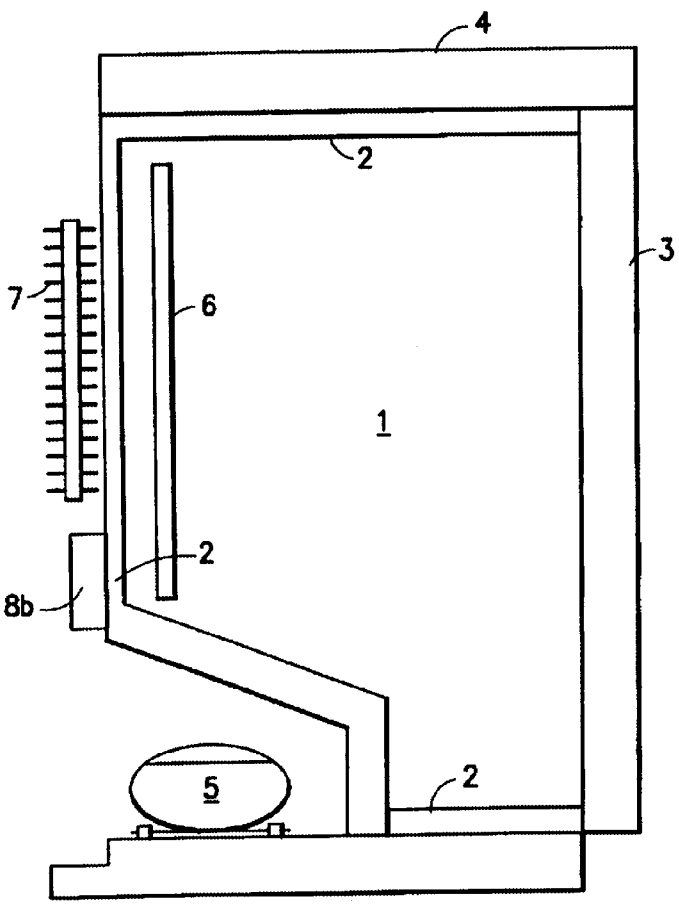
Figure 1E:
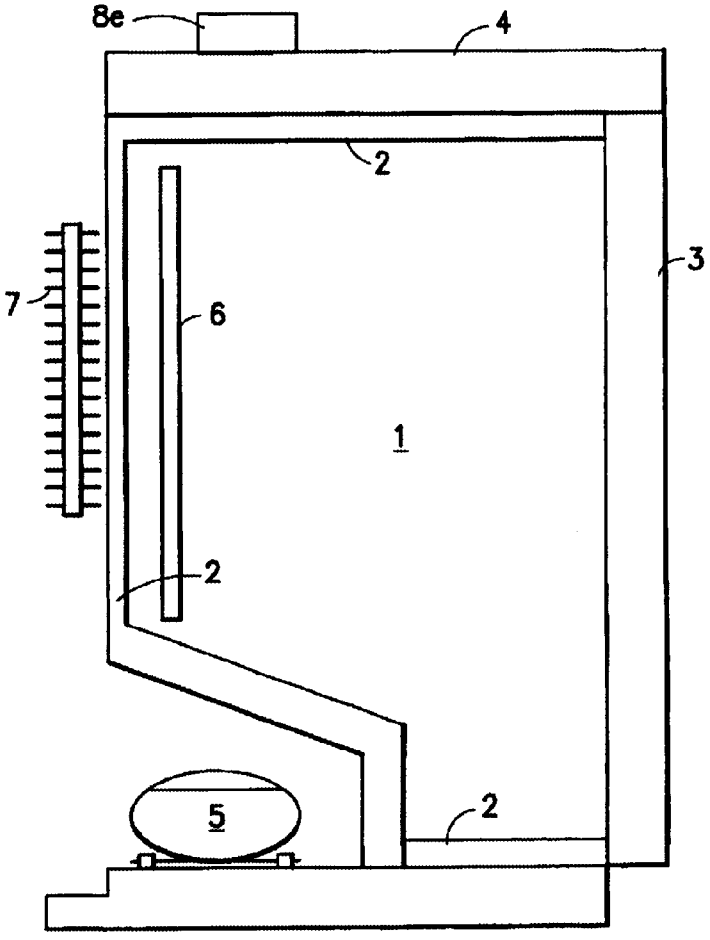

In each of the arrangements, the constructional unit 8*a*–8*i* is arranged spacially separated from the compressor 5. Accordingly, the constructional units are oscillation-insulated and thermally separated with respect to the compressor. In FIG. 1*a*, the constructional unit 8*a* lies in a region between the wall 2 and the outer side of the insulation 4 (not shown in this region of the wall 2). The arrangement of constructional unit 8*a* with regard to the distance to the wall 2 may vary as described below with reference to constructional units 8*d*, 8*e* and 8*f*. The same applies to the constructional units 8*b* and 8*c* of FIGS. 1*b* and 1*c* arranged above or below the condensor 7. In the arrangements of FIGS. 1*b* and 1*c*, the airflow which forms in the region of the condenser by convection may be exploited for cooling of the power electronics located in the constructional units 8*b*, 8*c*. The arrangement of constructional unit 8*a* above the compressor 5 or constructional units 8*b* or 8*c* near the rear wall has the advantage of having shorter cable paths.

Figure 1D:
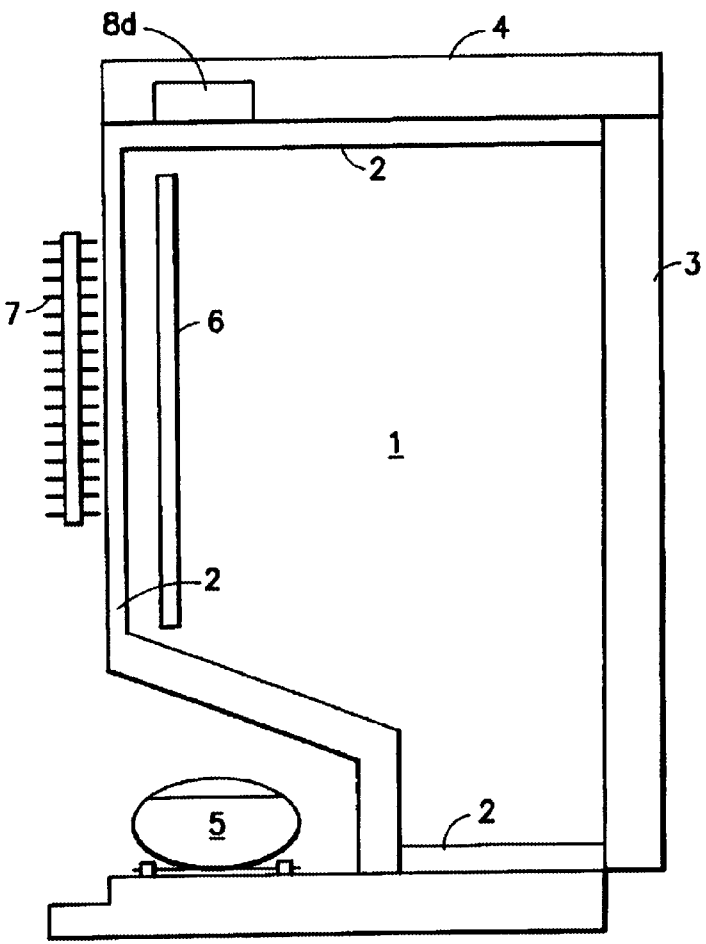

In FIG. 1*d*, the constructional unit 8*d* is arranged within the insulation 4 such that the constructional unit 8*d* bears on the wall 2 limiting the top of the cooling space 1. Such an arrangement may be used when a cooling of the constructional unit is to be effected exclusively via the cooling space. If a cooling of the electronics via the cooling space 1 is not to be effected at all, the arrangement of the constructional unit 8*e* shown in FIG. 1*e* may be used wherein the constructional unit 8*e* is arranged on the outer side of the insulation 4. In this embodiment, the cooling space 1 is protected by the insulation 4 which lies under the constructional unit 8*e* and the heat produced by the electronics in the constructional unit 8*e* rises and is removed here by way of suitable cooling bodies.

Figure 1G:
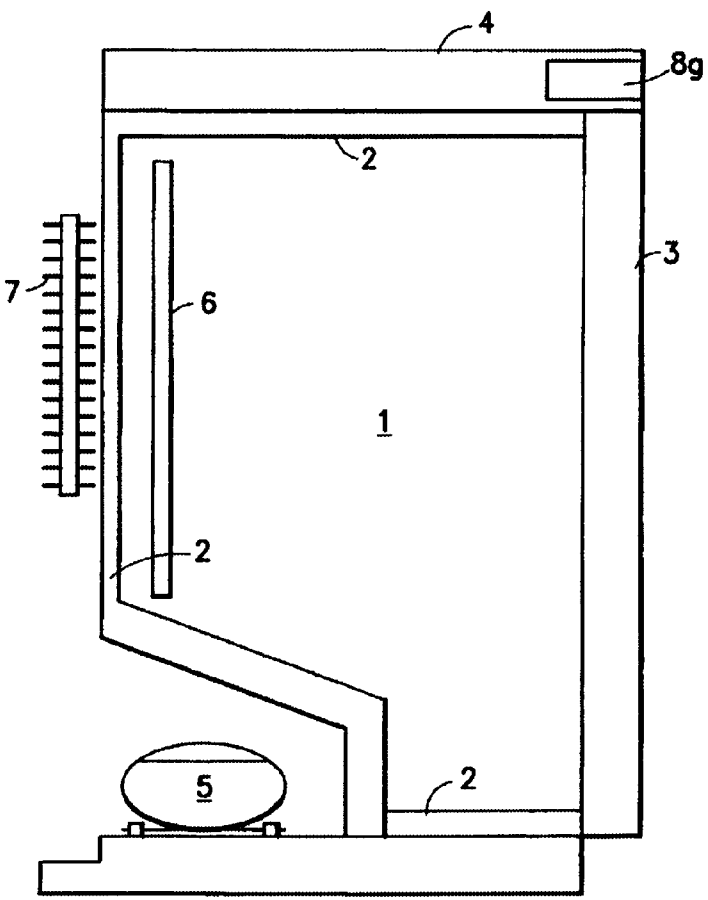
Figure 1F:
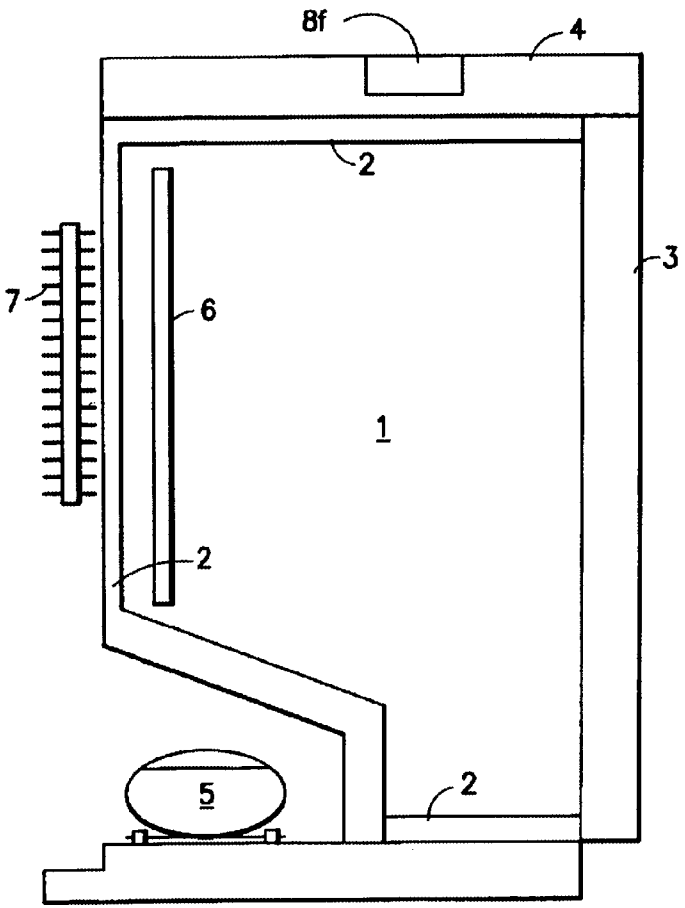

The arrangement of the constructional unit 8*f* in FIG. 1*f* allows a combined cooling. Here the constructional unit 8*f* lies in the insulation 4 at a distance from the wall 2 and within the insulation 4. The constructional unit 8*f* is thus also heat-insulated with respect to the wall 2 which helps avoid condensed water problems.

The constructional unit 8*g* in FIG. 1*g* is typically applied into the insulation 4 from the front of the cooling device. The constructional unit 8*g* may also include a lighting for the cooling space, the corresponding door contact switch as well as where appropriate a temperature display visible on the front side, and further control lights and switches.

Figure 1I:
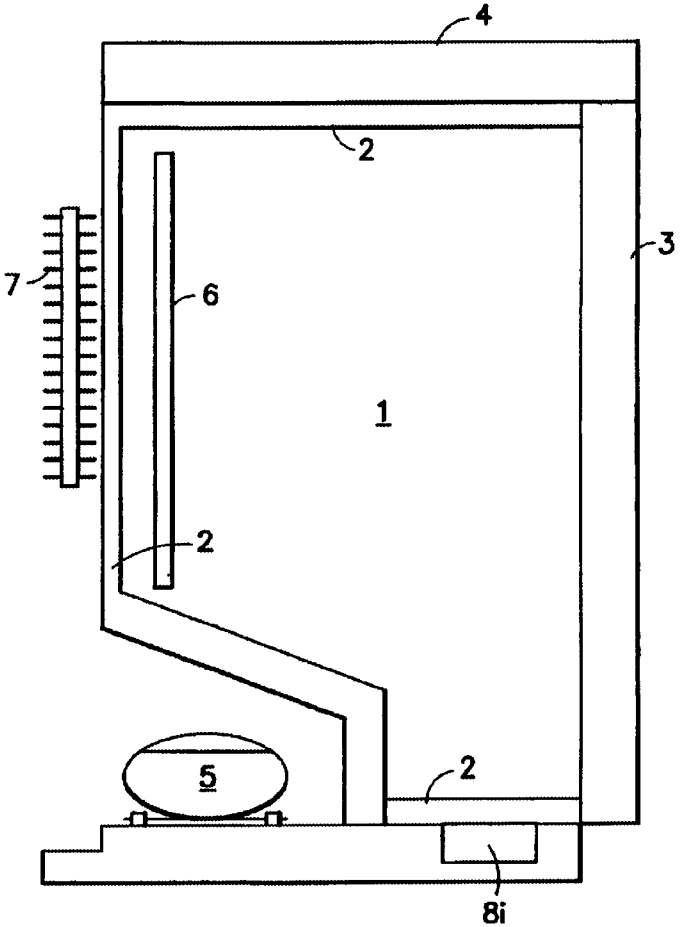
Figure 1H:
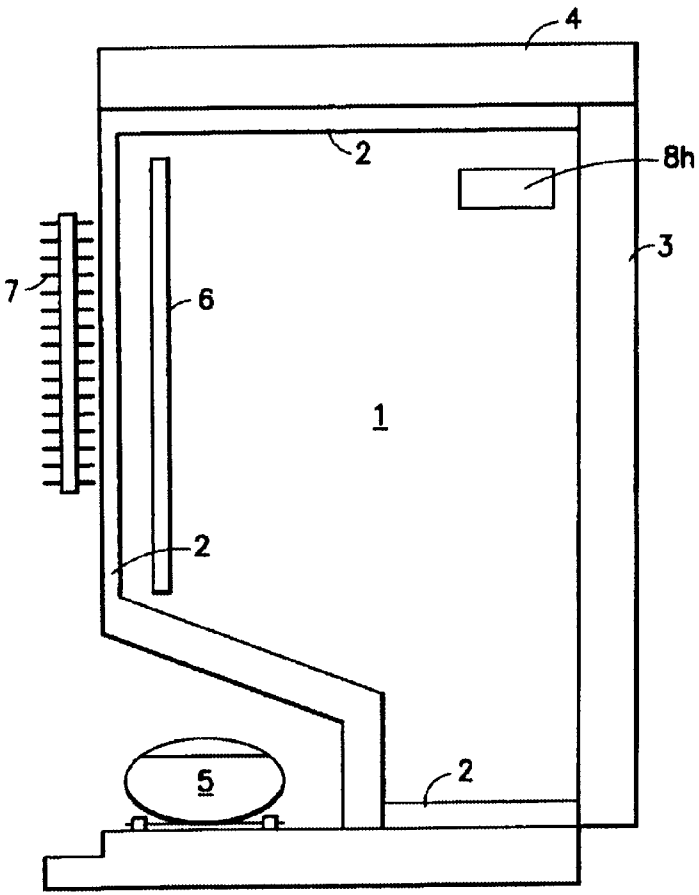

The constructional unit 8*h* of FIG. 1*h* is arranged within the cooling space 1 and apart from the lamp and door contact switch also comprises the temperature setter for selecting the temperature of the cooling space 1.

The constructional unit 8*i* of FIG. 1*i* is arranged in the base of the cooling device such that it is connected to the sheet metal chassis in a heat conducting manner. Heat is dissipated from the constructional unit 8*i* via the base plate stamped out of sheet metal.

Figure 2:
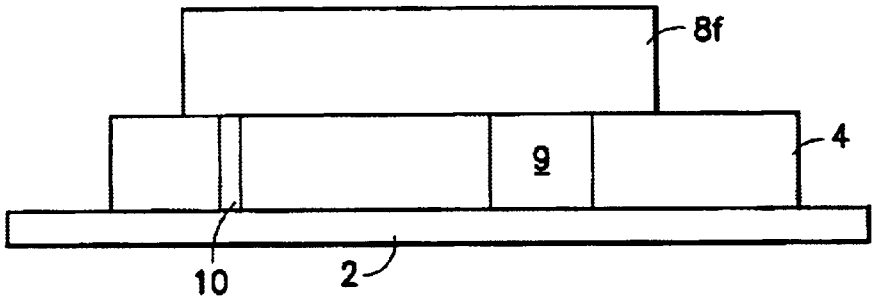
FIG. 2 is an enlarged schematic representation of an arrangement of a constructional unit at a distance to the cooling space wall and which is cooled via the cooling space.

As shown in FIG. 2 the constructional unit 8*f* may indeed be arranged at a distance to the wall 2 and still be cooled via the cooling space. A heat spreader 9 is arranged proximate the underside of the constructional unit 8*f* which bears on the wall 2 and is connected to the wall 2 in a heat conducting manner. The heat arising within the constructional unit 8*f* is thus at least partly transmitted via the heat spreader 9 onto the wall 2 and thus onto the air which located in the cooling space 1 and which is cooled by the evaporator 6.

A peg-like formation 10 is provided on the underside of the constructional unit 8*f* at a significant distance from the heat spreader 9. A temperature sensor is arranged near the lower end of the peg-like formation which is also connected to the wall 2 via a heat conducting connection. This temperature sensor detects the cooling space temperature and is allocated to the control located in the constructional unit 8*f*. The distance between the peg-like formation 10 and the heat spreader 9 is selected such that the influence of the heat given from the heat spreader 9 to the wall 2 and the air located in the cooling space 1 is as low as possible. The upper side of the constructional unit 8*f* may additionally be cooled by convection. In the arrangement of FIG. 2, the insulation 4 to the wall 2 is largely protected from condensed water and the wall 2 in this region remains closed so that there arise no further cold bridges to the cooling space 1 and unsealedness of the cooling space.

Figure 3:
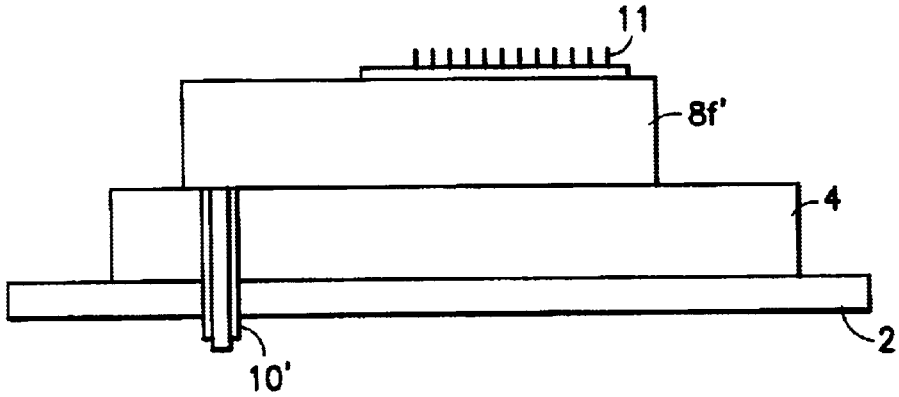
FIG. 3 is an enlarged schematic representation of an arrangement similar to that of FIG. 2 in which the constructional unit is cooled from the outside via convection cooling.

FIG. 3 shows an embodiment of a constructional unit 8*f* which is a variation of the constructional unit 8*f*. The arrangement corresponds essentially to that previously described with reference to constructional unit 8*f*, i.e. is separated at a distance to the wall 2 by an insulation 4. In contrast to the previously described embodiment, the heat generated by constructional unit 8*f* is not removed via the cooling space. Rather it is dissipated exclusively to the surrounding air. The upper side of the constructional unit 8*f* includes a cooling body 11. Of course, the cooling body 11 may alternatively or additionally be arranged on the sides of the constructional unit 8*f*. To minimize the errors in detecting the temperature within the cooling space 1 and thereby ensure a sensitive control, the constructional unit 8*f* includes a peg-like formation 10' which passes through the insulation 4 and the wall 2. The peg-like formation 10' is led through a suitable recess in the wall 2 into the cooling space 1 so that a temperature sensor arranged at the lower end of the peg-like formation 10' lies within the cooling space 1.

The constructional unit may also be arranged directly bearing on the wall 2 if an almost exclusive heat removal via the cooling space 1 is desired as shown in FIG. 1*d*.

Figure 4:
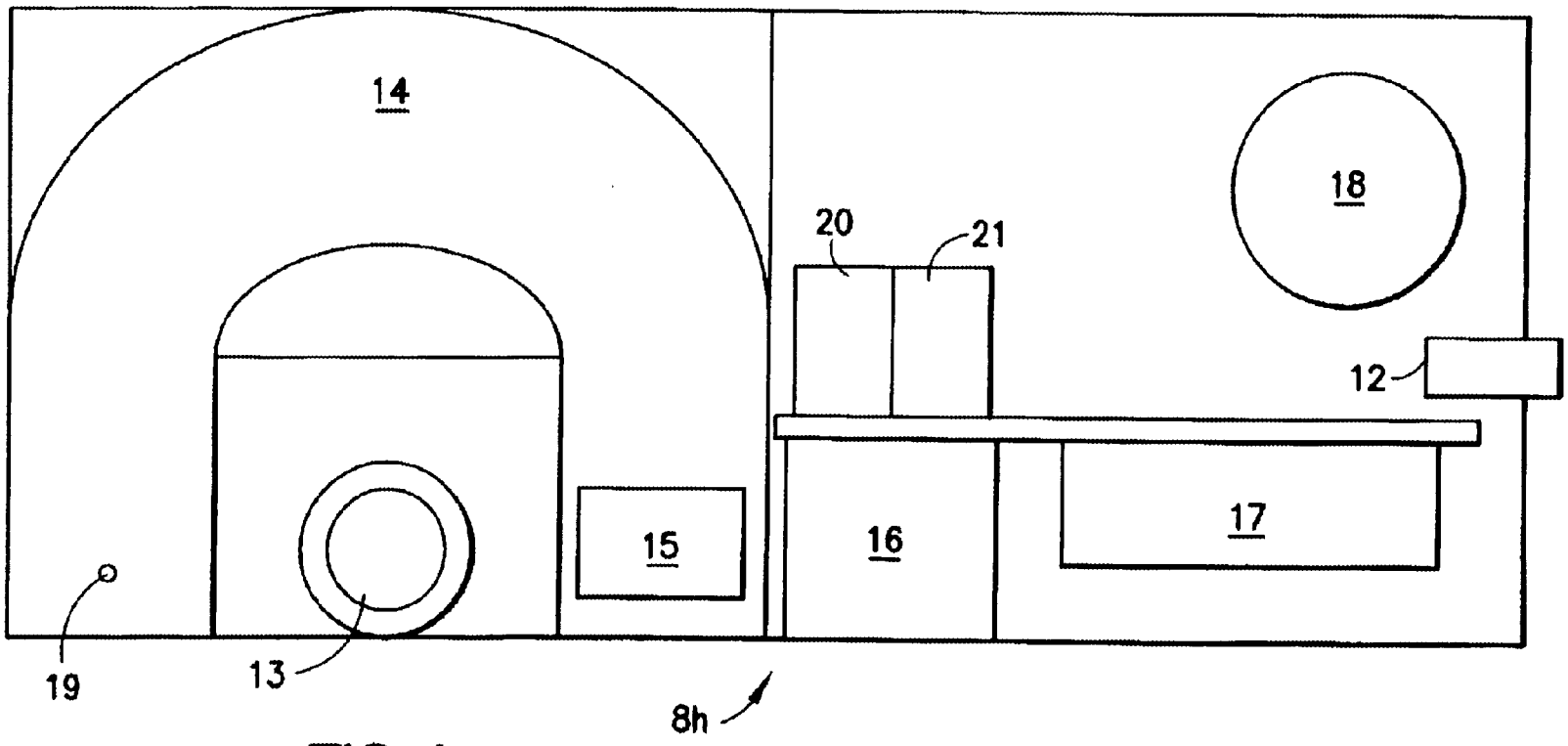
FIG. 4 is a schematic representation of a constructional unit arranged inside a cooling space of a cooling device.

The constructional unit 8*h* shown in FIG. 1*h* lies within the cooling space 1. The constructional unit 8*h* may, for example, have the construction shown in FIG. 4. A front side of the constructional unit 8*h* comprises a switch contact 12 controlled by the door 3. The switch contact switches the cooling space lighting on and off. The cooling space lighting includes a lamp 13 which is also integrated in the constructional unit 8*h*. An air channel 14 surrounds the lamp 13 and a fan 15 is seated within the air channel. Both the air channel 14 and the fan 15 are part of the constructional unit 8*h*. The fan 15 and the air channel 14 operate to directly cool the power electronics. Furthermore, the fan 15 and air channel 14 also produce an intensive air circulation in the cooling space.

The power electronics 16 of the frequency converter and the control electronics 17 are arranged in the front part of the constructional unit 8*h*. Further electronics may be integrated within the constructional unit 8*h* such as a wireless data communication device 20 and a controller 21 for defrosting the evaporator 6. A setting wheel 18 is accessible from the outside and serves the pre-selection of the cooling space temperature. A temperature sensor 19 is arranged within the cooling channel 14 near to the one end so that also when the ventilator is not operating, the temperature of the cooling space 1 may be measured.

Figure 5:
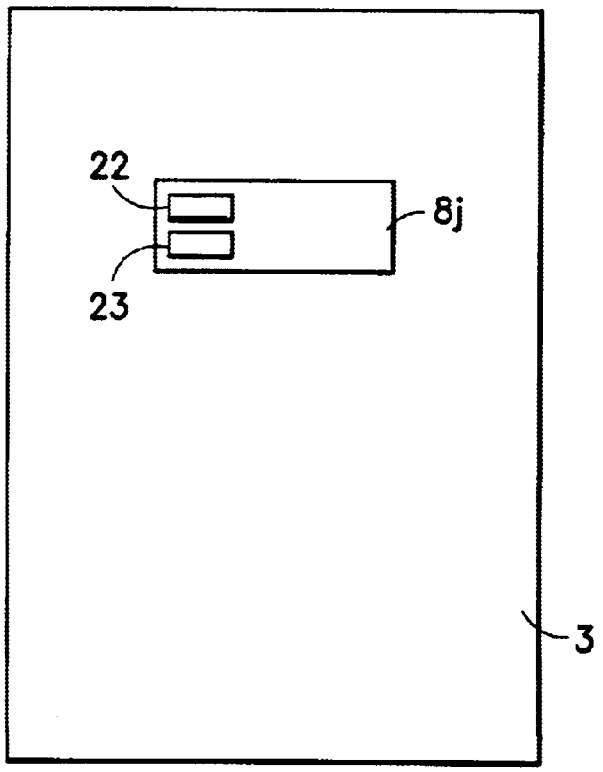
FIG. 5 is a schematic representation of a door of the cooling device with a constructional unit arranged thereon.

FIG. 5 shows an embodiment in which a constructional unit 8*j* is arranged on the door 3 of the cooling device. The constructional device 8*j* includes additional electrical/electronic components including a temperature display 22 for displaying a temperature of the cooling space and an operating condition display 23. The operating condition display may indicate when the compressor is running, the current efficiency of the cooling device, and any other indication which may be deemed useful.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A cooling device, comprising:

a cooling space wall and a door defining a cooling space;

a compressor having an electrical drive motor;

a rotational speed controller operatively connected for controlling said electrical drive motor;

a cooling medium circuit having a condensor, an evaporator and an expansion device arranged between said condenser and said evaporator;

a temperature control for controlling a temperature of said cooling space; and a constructional unit in which both said rotational speed controller and said temperature control are arranged.

2. The cooling device of claim 1, wherein said constructional unit is spatially separated from said compressor.

3. The cooling device of claim 1, wherein said constructional unit further comprises a sensor for acquiring a reference variable for said temperature control.

4. The cooling device of claim 1, wherein said constructional unit is arranged on said cooling space wall.

5. The cooling device of claim 1, further comprising a heat conducting connection between said constructional unit and said cooling space wall, wherein at least part of the waste heat generated by said rotational speed controller is dissipated into said cooling space via said heat conducting connection.

6. The cooling device of claim 1, wherein said rotational speed controller comprises an electronic frequency converter.

7. The cooling device of claim 1, wherein said rotational speed controller comprises one of a pulse cascade control and a phase control.

8. The cooling device of claim 1, wherein said constructional unit comprises further electrical/electronic components including one of a temperature display and an operating condition display.

9. The cooling device of claim 3, wherein said sensor comprises a temperature sensor which projects through a recess in said cooling space wall and into said cooling space.

10. The cooling device of claim 9, wherein said temperature sensor is connected to said cooling space wall via a heat-conducting connection.

11. The cooling device of claim 1, further comprising cooling space lighting, wherein said construction unit further comprises a switch for said cooling space lighting.

12. The cooling device of claim 11, wherein said cooling space lighting is arranged on said constructional unit.

13. The cooling device of claim 1, wherein said constructional unit further comprises a fan for circulating air located in said cooling space.

14. The cooling device of claim 1, wherein said constructional unit further comprises a wireless data communication device for allowing remote setting of the temperature of said cooling space.

15. The cooling device of claim 1, wherein said constructional unit further comprises a control for defrosting said evaporator.

16. The cooling device of claim 1, wherein said constructional unit is assembled inside said cooling space.

17. The cooling device of claim 1, wherein the constructional unit is assembled on said door.

18. The cooling device of claim 1, wherein said constructional unit is assembled near an outer side of said cooling device such that waste heat generated by electronics is dissipated into the surrounding air.

19. The cooling device of claim 1, wherein the constructional unit contains several rotational speed controllers and controls.

* * * * *